US006704997B1

(12) United States Patent
Osada et al.

(10) Patent No.: US 6,704,997 B1
(45) Date of Patent: Mar. 16, 2004

(54) METHOD OF PRODUCING ORGANIC THERMISTOR DEVICES

(75) Inventors: Shinichi Osada, Shiga (JP); Tomozo Yamanouchi, Shiga (JP); Yuichi Takaoka, Shiga (JP); Takashi Shikama, Shiga (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/690,119

(22) Filed: Apr. 27, 2000

Related U.S. Application Data

(62) Division of application No. 09/412,445, filed on Oct. 4, 1999, now abandoned.

(30) Foreign Application Priority Data

Nov. 30, 1998 (JP) ..... 10-338979

(51) Int. Cl.[7] ..... H01C 7/04

(52) U.S. Cl. ..... 29/612; 29/613; 29/614; 29/619; 29/884; 264/171.16; 338/22 R; 338/203; 427/101

(58) Field of Search ..... 29/610.1, 611–614, 29/619, 621, 883; 264/138, 145, 165, 171.14, 171.16, 272.12, 272.18; 338/22 R, 225 D, 203, 212, 223; 427/101, 133, 434.6

(56) References Cited

U.S. PATENT DOCUMENTS 4,330,703 A * 5/1982 Horsma et al. ..... 219/553
4,334,148 A * 6/1982 Kampe ..... 219/553
H415 H * 1/1988 Newnham et al. ..... 338/22 R
4,786,888 A * 11/1988 Yoneda et al. ..... 29/612
5,614,074 A * 3/1997 Ravindranathan ..... 205/50
5,994,995 A * 11/1999 Ogasawara et al. ..... 338/21

FOREIGN PATENT DOCUMENTS

| | | |
|---|---|---|
| JP | 63/160189 | 7/1963 |
| JP | 09-069416 | 3/1997 |
| JP | 09/129416 | 5/1997 |
| JP | 09/199302 | 7/1997 |

* cited by examiner

*Primary Examiner*—Peter Vo
*Assistant Examiner*—Donghai D. Nguyen
(74) *Attorney, Agent, or Firm*—Beyer Weaver & Thomas LLP

(57) ABSTRACT

Organic thermistor devices are produced by a first step of molding an organic thermistor material by covering a plurality of electrically conductive members to form a conductor-containing member, which is elongated in a longitudinal direction, has a pair of mutually oppositely facing side surfaces, having the conductive plates buried parallel to one another inside the organic thermistor material, each mutually adjacent pair of these conductive members being externally exposed on different ones of the side surfaces, a second step of forming a pair of electrodes elongated in the longitudinal direction on the side surfaces of the conductor-containing member, and a third step of thereafter cutting this conductor-containing member transversely at specified positions so as to divide into individual units.

5 Claims, 5 Drawing Sheets

METHOD OF PRODUCING ORGANIC THERMISTOR DEVICES

This is a divisional of application Ser. No. 09/412,445 filed Oct. 4, 1999, now abandoned.

BACKGROUND OF THE INVENTION

This invention relates to a method of producing surface-mountable thermistor devices which may be used for protection against an overcurrent. More particularly, this invention relates to a method of producing organic thermistor devices comprising a thermistor element made of an organic thermistor material.

Organic PTC (positive temperature coefficient) thermistors made of an organic thermistor material are coming to be used as circuit protection units for suppressing overcurrents. Such organic PTC thermistor devices make use of an organic thermistor material obtained by dispersing carbon or the like in a resin material such as polyethylene to provide a positive temperature characteristic (PTC characteristic). They are generally produced, as shown in FIG. 6, by forming surface electrodes 52*a* and 52*b* by pressing a metallic foil of nickel or copper on both upper and lower surfaces of a thermistor body 51 of an organic thermistor material shaped in a planar form and then forming outer electrodes 53*a* and 53*b* by plating or sputtering. Alternatively, an organic thermistor device may be formed, as shown in FIG. 7, by using an electrically insulating material 54 such as an insulating resin to cover exposed parts such as the thermistor body 51 and the surface electrodes 52*a* and 52*b*, leaving only the outer electrodes 53*a* and 53*b* exposed.

An organic thermistor device, as described above, may be surface-mounted, as shown in FIG. 8, by electrically and mechanically connecting the outer electrodes 53*a* and 53*b* to wiring electrodes (or "lands") 56 on a printed circuit board 55 by a solder reflowing method through a solder fillet 57.

In the case of a PTC thermistor device for protecting a circuit from an overcurrent situation, its resistance value at normal temperatures is desired to be 0.1 Ω or less such that a voltage drop in the PTC thermistor device during the use of the circuit can be avoided. If the specific resistance, the thickness and the cross-sectional area of the PTC thermistor body 51 are ρ, T and S, respectively, the resistance value of the PTC thermistor device is given by ρT/S.

If an organic PTC material is to be used for the PTC thermistor device, the fact is that it is currently considered difficult to make the specific resistance equal to or less than 0.5 cm if this PTC thermistor material must also have the required electrical characteristics when its resistance value changes suddenly under a high-temperature condition. Accordingly, if it is attempted to use such an organic PTC thermistor material to produce an organic PTC thermistor device with resistance value equal to or less than 0.1 Ω at normal temperatures, the result will be a structure as shown in FIG. 7 having surface electrodes 52*a* and 52*b* formed on both upper and lower surfaces of a planar thermistor body 51 made of an organic thermistor material by pressing a metallic foil of nickel or copper.

Even if a PTC thermistor device is produced in a form as shown in FIG. 7 with surface electrodes on both upper and lower surfaces of the thermistor body, the thickness of the thermistor body 51 must be made very small and its cross-sectional area large in order to make its resistance value at normal temperatures equal to or less than 0.1 Ω. With prior art organic PTC thermistor devices, therefore, the dimensions of the thermistor body 51 were, for example, 4.5 mm (length)×3.2 mm (width)×0.3 mm (thickness).

Although it is an essential requirement for a PTC thermistor device to have a reduced resistance value at normal temperatures, this requirement could be satisfied with the prior art technology only by reducing the thickness of the thermistor body and increasing its cross-sectional area (or its planar area). As a result, the planar dimensions of the product remained large and a large space was required for its surface-mounting. Secondly, a relatively large amount of organic thermistor material will be used for the production and this gives rise to an increased production cost. Thirdly, if the thermistor body is very thin, it is likely to become twisted or bent after being mounted. Fourthly, if a large amount of the organic thermistor material is used between the pair of outer electrodes, the action time of the PTC thermistor device becomes long and there may arise situations where a sufficient protective characteristic against overcurrents cannot be obtained and the circuit element to be protected may break before the PTC thermistor device can act.

An attempt may be made to introduce inner electrodes into the PTC thermistor body by stacking organic PTC sheets with an electrode formed thereon, but the layer-forming process including steps of making thinner organic PTC sheets, forming conductors to serve as inner electrodes and stacking up the sheets one on top of another tends to increase the production cost as a whole. Thus, the price of the product will increase significantly and hence such a method is not a practical solution to the problem.

SUMMARY OF THE INVENTION

It is therefore an object of this invention, in view of the problems described above, to provide a method of producing compact organic thermistor devices which have a small resistance value at normal temperatures and are economically advantageous.

Organic thermistor devices to be produced according to this invention may each be characterized as comprising a thermistor body made of an organic thermistor material, a pair of outer electrodes on mutually opposite end parts of the thermistor body and facing each other, and a plurality of mutually parallel longitudinally extending planar inner conductors with thickness 10–200 μm disposed inside the thermistor body. Each mutually adjacent pair of these inner conductors are connected to different ones of the outer electrodes and has main surfaces which are in a face-to-face relationship with each other with the organic thermistor material inserted in between. The externally exposed surfaces of the device, except where the outer electrodes are formed, may be covered by an insulating material for preventing unwanted electrical contact of the thermistor body or the inner conductors with other conductors such as various components and wires on a circuit board.

Alternatively, these planar conductors may be replaced by a plurality of metallic wires, or a bar with a circular or quadrangular cross-sectional shape. Since the specific resistance of the metallic conductor is negligibly small, compared to that of the organic thermistor material, the resistance value of the device can be thereby reduced.

A method according to this invention for producing such organic thermistor devices may be characterized by the steps of molding an organic thermistor material by covering a plurality of electrically conductive plates to thereby form an elongated conductor-containing member having these conductive plates buried parallel to one another inside the organic thermistor material such that each mutually adjacent pair of these conductive plates is externally exposed on different ones of mutually oppositely facing side surfaces of the member, forming a pair of longitudinally elongated electrodes on these side surfaces, and thereafter cutting this conductor-containing member transversely at specified positions to thereby divide into individual units. Such electrodes may be formed by coating externally exposed surfaces of the conductor-containing member entirely with an electrically insulating material, thereafter removing portions of it from the side surfaces to thereby expose edges of the conductive plates, and thereafter forming the electrodes on the side surfaces.

By initially forming such a conductor-containing member, organic thermistor devices of this invention can be produced efficiently.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like or equivalent components are indicated by the same symbols even where they are components of different organic thermistor devices and may not necessarily be described repetitiously for simplifying the disclosure.

DETAILED DESCRIPTION OF THE INVENTION

The invention is described next by way of examples.

Figure 1A:
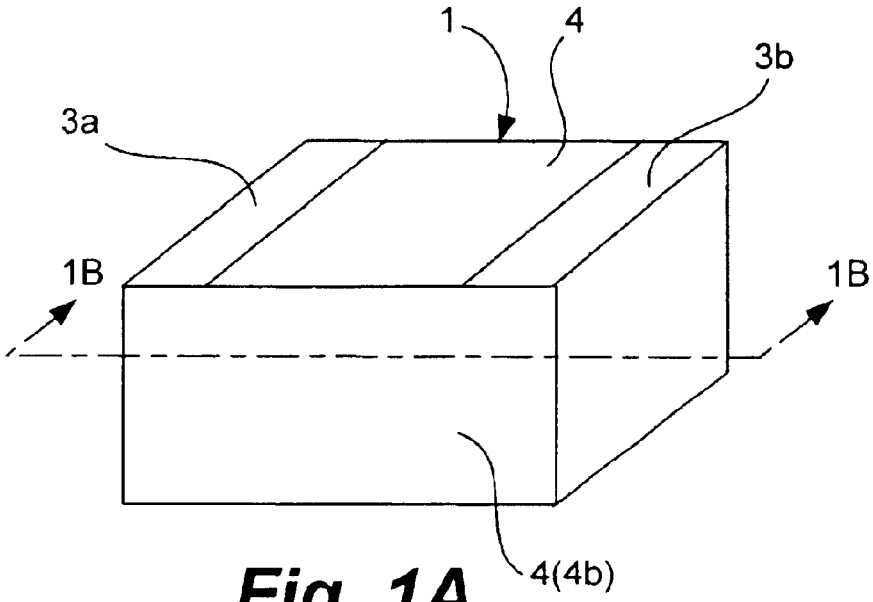
FIG. 1A is a diagonal external view of an organic thermistor device produced by a method of this invention.
Figure 1B:
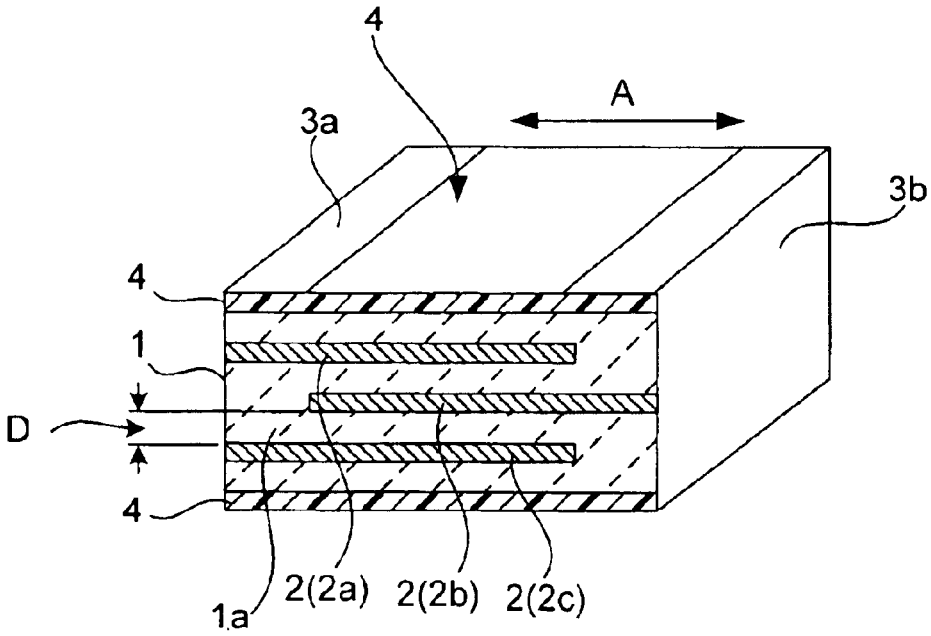
FIG. 1B is its sectional view taken along line 1B—1B of FIG. 1A.

FIGS. 1A and 1B are respectively an external view and a sectional it view of an organic thermistor device to be produced by a method of this invention. Outer electrodes 3*a* and 3*b* are formed as a pair on mutually opposite end parts of a thermistor body 1 comprising an organic thermistor material obtained by dispersing carbon in a resin material such as polyethylene so as to provide a PTC characteristic. Inside the thermistor body 1 are a plurality of electrically conductive plates (herein referred to as the "inner conductors 2") disposed parallel to each other in the direction (indicated by arrow A in FIG. 1B) in which the pair of outer electrodes 3*a* and 3*b* faces each other. The externally exposed surfaces of the thermistor body 1 and the surface areas of the inner conductors 2 externally exposed from the thermistor body 1 are entirely covered by an electrically insulating material 4 (such as an insulating resin). The thickness of the inner conductors 2 is preferably in the range of 10–200 $\mu$m. If the thickness is less than 10 $\mu$ m, the inner conductors 2 cease to be sufficiently rigid and it becomes impossible to produce reliable products inexpensively by an extrusion molding method (to be explained in detail below). If the thickness exceeds 200 $\mu$ m, on the other hand, the organic PTC material cannot fill the gap in between at the time of the molding process, raising the probability of forming air bubbles inside.

According to one example of this embodiment, the inner conductors 2 each comprise a thin copper plate subjected to a nickel plating process. The nickel plating serves to improve the contact between the inner conductors and the organic thermistor material 1*a* of the thermistor body 1. In order to further improve this contact, it is preferable to roughen the contact surfaces of the inner conductors 2 to a roughness of about $R_a$=0.1–10.0 $\mu$m.

According to the embodiment shown in FIG. 1B, there are three inner conductors 2 disposed parallel to one another and also to the upper and lower main surfaces of the thermistor body 1, such that the distance D of separation between each mutually adjacent pair of them is 0.1–0.3 $\mu$ mm and that the inner conductors 2 which are mutually adjacent are attached to mutually different ones of the outer electrodes 3*a* and 3*b*, those on the top and bottom layers (with reference to FIG. 1B) being connected to outer electrode 3*a* and the one in the middle being connected to outer electrode 3*b*. The number of inner electrodes to be disposed inside the thermistor body 1, however, is not intended to limit the scope of the invention.

Although not shown in detail, the outer electrodes 3*a* and 3*b* are each of a layered structure with a nickel layer formed on the surface of the thermistor body 1 by sputtering and a layer of tin or a tin alloy formed over the nickel layer by electrolytic plating.

Figure 2B:
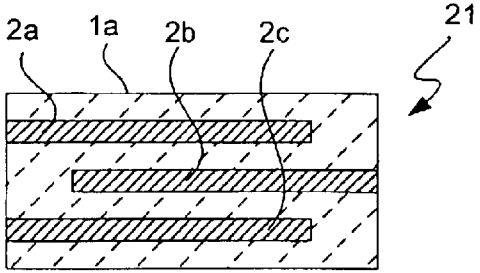
FIGS. 2A, 2B, 2C, 2D, 2E, 2F and 2G are views of the organic thermistor device of FIGS. 1A and 1*b* at various stages of its production by a method embodying this invention.

Organic thermistor devices as described above may be produced as follows. Firstly, as shown in FIG. 2A, three reels 11 (or 11*a*, 11*b* and 11*c*), each with a metallic sheet of thickness 0.2 mm and width 2.5 mm wound around it, are provided and three thin, tape-like elongated metallic sheets 2*a*, 2*b* and 2*c* pulled out of them are passed through a three-hole dice nipple 12 of a molding machine while an organic thermistor material 1*a* which has been heated and has become soft is poured in to form by extrusion molding a flat elongated conductor-containing member 21 having the metallic sheets 2 buried inside the organic thermistor material 1*a* as shown in FIG. 2B. When the three metallic sheets 2*a*, 2*b* and 2*c* are introduced into the dice nipple 12, the middle one 2*b* is positioned so as to be laterally displaced with respect to the others (2*a* and 2*b*) by a specified distance such that the staggered positioning as shown in FIG. 2B can be achieved. The flat elongated conductor-containing member 21 thus formed is wound up around another reel 13 (shown in FIG, 2C).

Figure 2D:
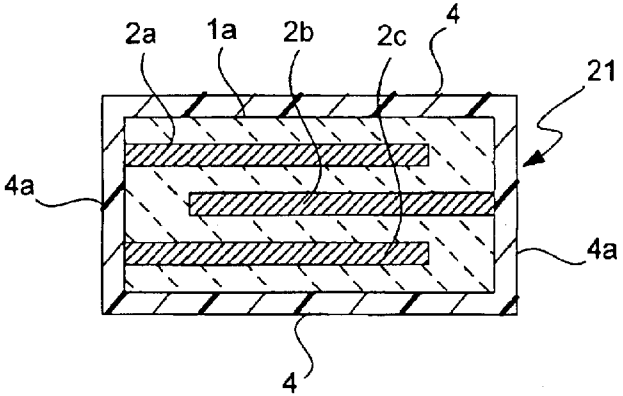
Figure 2A:
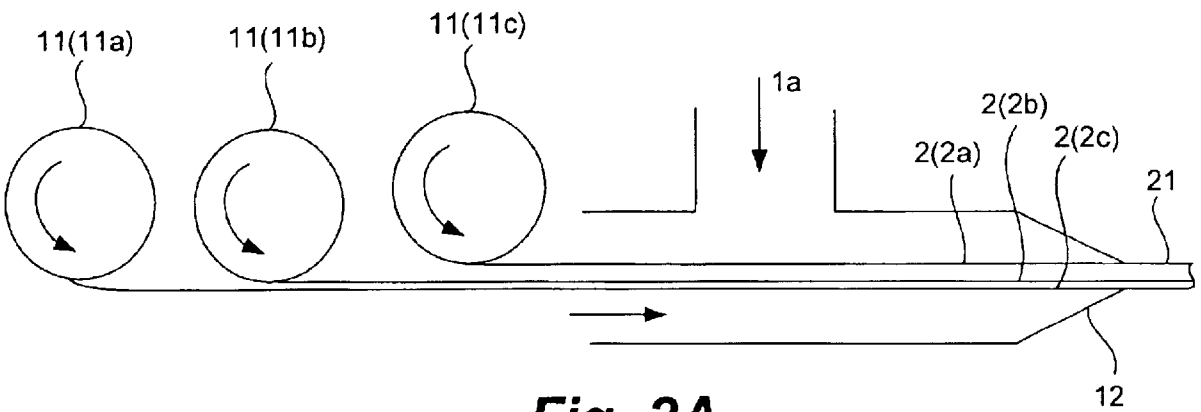
Figure 2C:
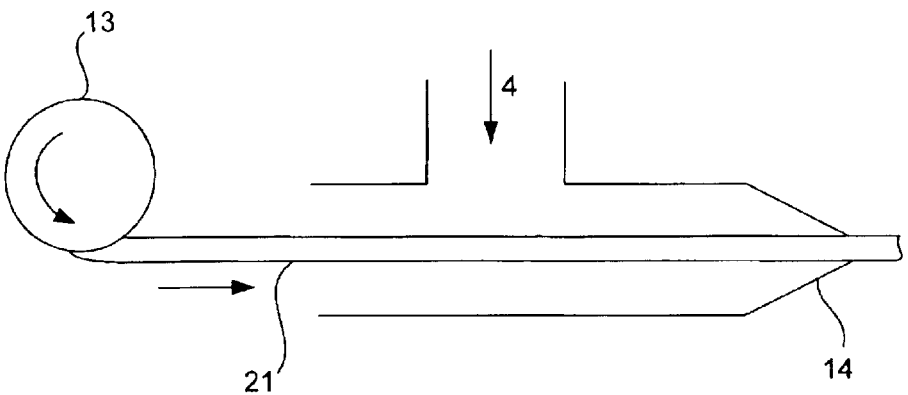

Next, as shown in FIG. 2C, the elongated conductor-containing member 21 is pulled out of the reel 13 and is guided to a single-hole dice nipple 14 of a molding machine while an electrically insulating resin material 4 which has been heated and has become soft is poured in to cover the elongated conductor-containing member 21 with an insulating resin layer 4 and 4*a* around it, as shown in FIG. 2D.

Figure 2E:
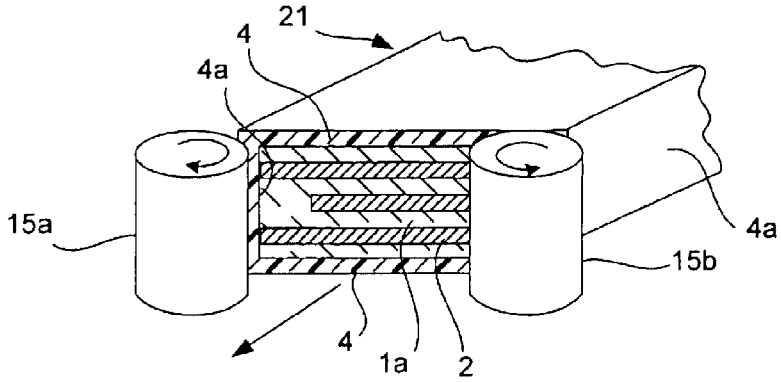
Figure 2F:
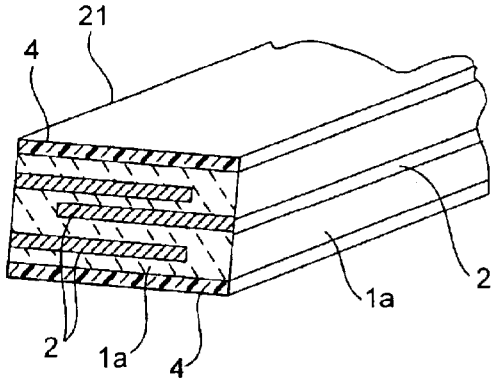

Next, portions of the insulating resin layer 4 (indicated by symbols 4*a*) are removed from a pair of specified longitudinally extending continuous areas on the outer peripheral surface of the organic thermistor material 1*a* where outer electrodes are later to be formed. This is done, as shown in FIG. 2E, by disposing a pair of grinders 15*a* and 15*b* each on a different side of the conductor-containing member 21 and the conductor-containing member 21 is passed longitudinally between this pair of grinders 15*a* and 15*b* to remove the portions 4*a* of the insulating resin layer 4 from both end surface sides such that the organic thermistor material 1*a* becomes exposed on both sides, as shown in FIG. 2F. Grinders with surface roughness of about #1000–2000 may be used for the purpose. Such grinders can improve the contact between the outer electrodes 3*a* and 3*b* and the organic thermistor material 1*a*, to be discussed below.

Figure 2G:
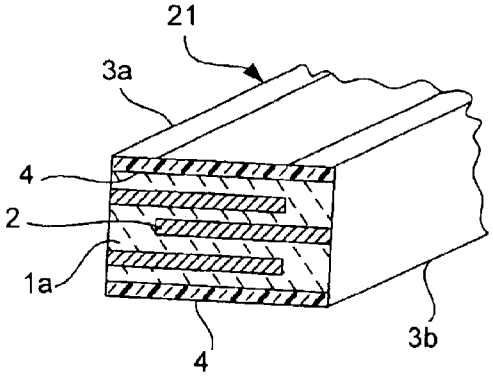

Next, nickel layers are formed by sputtering on the surfaces of the organic thermistor material 1*a* and the inner conductors 2 from which the insulating resin layers 4*a* have just been removed by the grinders 15*a* and 15*b*. Thereafter, solder layers or tin layers are formed over the nickel layers by electrolytic plating of a solder or tin in order to improve solderability when the outer electrodes 3*a* and 3*b* are formed, as shown in FIG. 2G.

The elongated conductor-containing member 21, thus provided with the outer electrodes 3*a* and 3*b*, is now cut transversely, or nearly perpendicularly, to the direction of its elongation at specified intervals such as at intervals of 1.6 mm, to obtain individual units. Thereafter, an insulating resin 4 is applied to the newly exposed surfaces of these individually cut elements where the metallic conductors 2 have also become exposed, and the insulating resin 4 thus applied is hardened by an exposure to an ultraviolet beam to. Organic thermistor devices as shown in FIG. 1A, are thus obtained.

Figure 7:
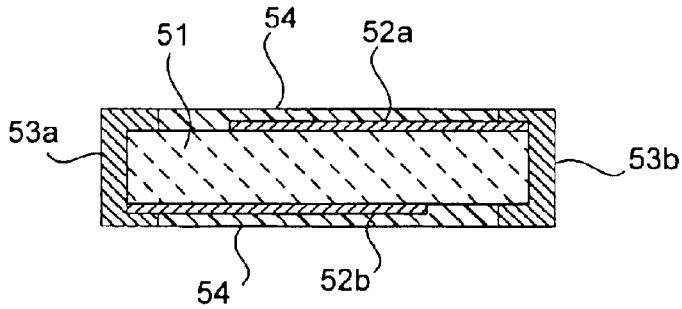
Fig. 7 (Prior Art)
FIG. 7 is a sectional view of another prior art organic thermistor device.
Figure 8:
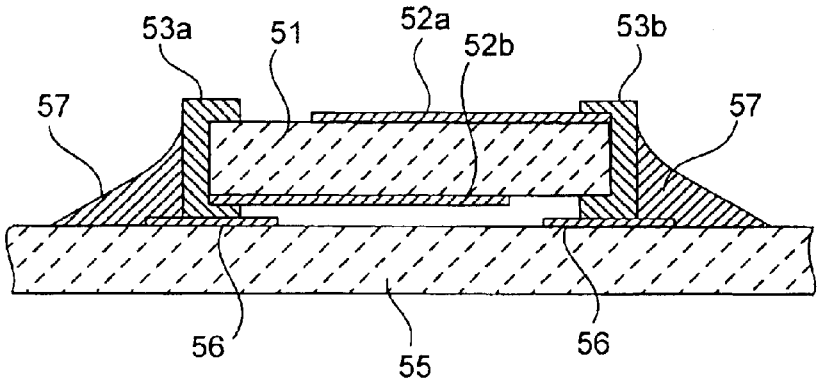
Fig. 8 (Prior Art)
FIG. 8 is a sectional view of a prior art organic thermistor device mounted to a circuit board.

By such a method, organic thermistor devices with a low resistance value can be made available since metallic conductors are buried inside the thermistor body such that each mutually adjacent pair has mutually overlapping surface areas with the thermistor material sandwiched in between. While prior art organic thermistor devices as shown in FIG. 7 had to have outer dimensions of about 4.5 mm (length)×3.2 mm (width)×0.3 mm (thickness), as explained above, the dimensions of organic thermistor devices according to this invention may be reduced to about 3.2 mm (length)×1.6 mm (width)×1.0–1.6 mm (thickness). Thus, an organic thermistor device of this invention requires a much smaller space for surface-mounting.

Figure 3:
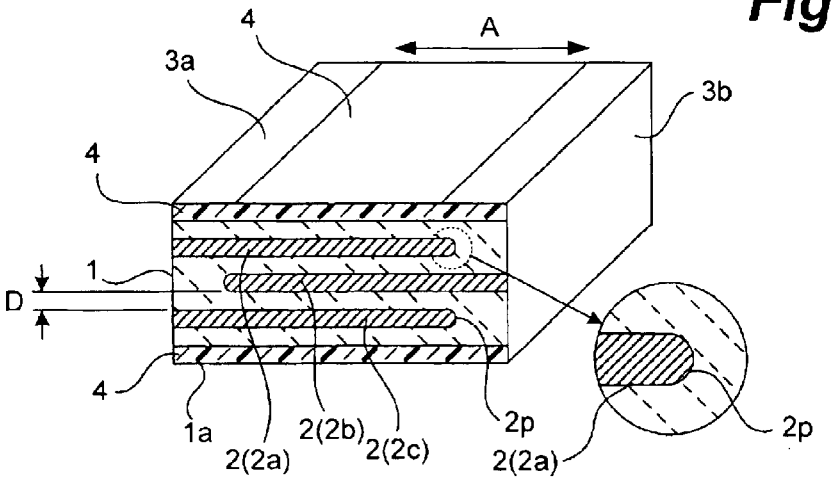
FIG. 3 is a sectional diagonal view of a variation of the organic thermistor device of FIGS. 1 and 2 with inner conductors having chamfered edges.

The invention is not limited by the example described above. Many modifications and variations are possible within the scope of the invention. Firstly, the process of obtaining individual units by cutting was described as taking place after the conductor which is later to become the outer electrodes is formed, the outer electrodes may be formed after the conductor-containing member is cut into the individual units. Secondly, it is preferable to carry out a chamfering process so as to round off the edges 2*p* of the inner conductors 2 away from where they are attached to the outer electrodes 3*a* and 3*b*, as shown in FIG. 3, so as to prevent the formation of air bubbles near these edges 2*p* because such air bubbles, if formed, tend to cause cracks and peeling. By such a chamfering process, it is possible to improve the reliability of the organic thermistor devices.

Figure 4A:
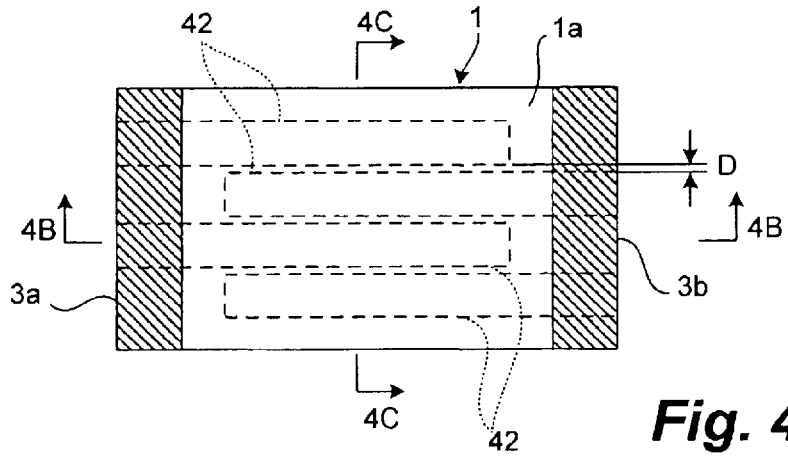
FIGS. 4A, 4B and 4C (together referred to as FIG. 4) are respectively a plan view of another organic thermistor device produced by a method of this invention, its sectional side view taken along line 4B—4B of FIG. 4A, and its longitudinal sectional view taken along line 4C—4C of FIG. 4A.
Figure 4B:
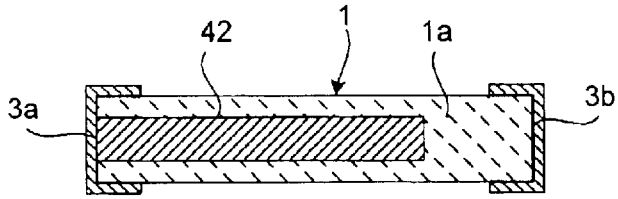
Figure 4C:
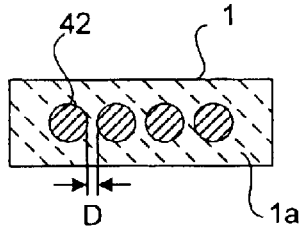

Thirdly, the inner conductors 2 need not be of a flat sheet-like shape. FIGS. 4A, 4B and 4C show another example of this invention characterized as using metallic wires 42 in the shape of a cylindrical bar with a circular cross-sectional shape as inner conductors. According to this embodiment, such metallic wires 42 are disposed in sequence and parallel to each other inside the organic thermistor material 1*a* substantially in the direction in which the outer electrodes 3*a* and 3*b* face each other, those of the wires 42 mutually adjacent to each other being connected to different ones of the outer electrodes 3*a* and 3*b*. The resistance value of the thermistor element 1 thus structured is determined by the distance D of separation between mutually adjacent ones of the sequentially disposed metallic wires 42, as well as the resistivity of the organic thermistor material 1*a*. Thus, an organic thermistor device with a sufficiently low resistance value at normal temperatures can be obtained by reducing the separation distance D between the metallic wires 42 although the resistivity of the organic thermistor material 1*a* cannot be reduced beyond a certain limit.

Figure 5A:
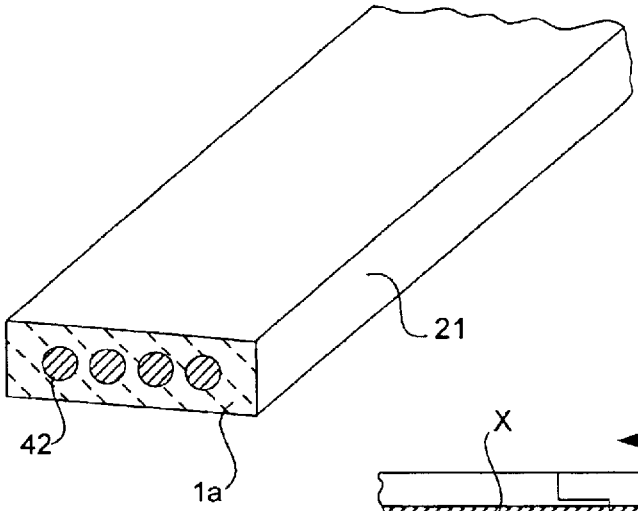
FIG. 5A is a diagonal view of a conductor-containing member for the production of organic thermistor devices according to another embodiment of this invention.
Figure 5B:
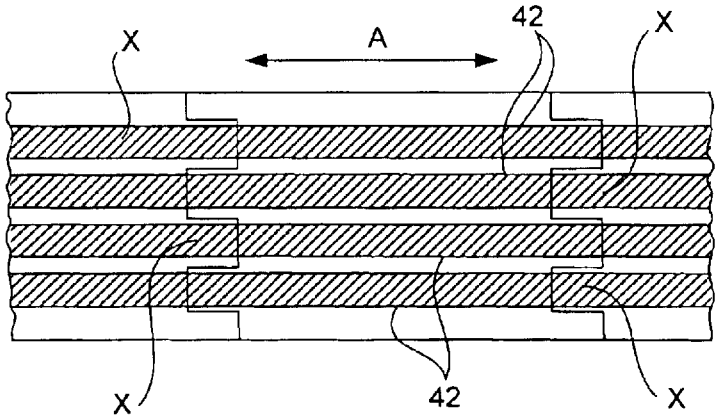
FIG. 5B is a sectional plan view of the conductor-containing member to show how it is cut for the production of the organic thermistor devices.
Figure 6:
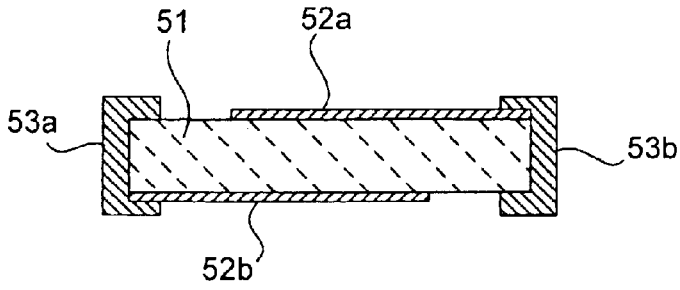
Fig. 6 (Prior Art)
FIG. 6 is a sectional view of a prior art organic thermistor device.

The organic thermistor device as shown in FIG. 4 can be produced by a similar method using an extrusion molding process. By such a method, a flat elongated conductor-containing member 21 as shown in FIG. 5A will be produced with a plurality of metallic wires 42 disposed parallel to one another inside an organic thermistor material 1*a*. Next, it is cut, as shown in FIG. 5B, generally in a direction perpendicular to the longitudinal direction (indicated by arrow A) along lines which are not straight but in a zigzag such that the ends of wires 42 in alternate arrays are retracted from those of the adjacent wires by about 0.2 mm. Thereafter, the indented edge portions (indicated by letters X in FIG. 5B), resulting from the shape in which the conductor containing member 21 was cut as explained above, are filled with the organic thermistor material so as to form each unit in the shape of a rectangular column without any indentations or protrusions as a whole. The outer electrodes 3*a* and 3*b* are formed on these individual units as shown in FIG. 4. It now goes without saying that the cross-sectional shape of these metallic wires 42 is not required to be a circle. Wires with a quadrangular cross-sectional shape, as well as wires with many other different cross-sectional shapes can be used for the purpose of this invention.

The material for the metallic wires 2 is not intended to limit the scope of the invention. If wires made of nickel, tin, aluminum, copper or an alloy having any of these as its main component are used, organic thermistor devices with a low resistance value at normal temperatures can be obtained without increasing the material cost excessively. If the wires are of aluminum or an alloy with aluminum as its principal component, the strength of attachment between the metallic wires and the organic thermistor can be increased by plating the surface of the wires with nickel, tin or copper. If the wires are of copper or an alloy with copper as its principal component, the strength of attachment between the metallic wires and the organic thermistor can be increased by plating the surface of the wires with nickel.

It is also to be reminded that the diameter of the metallic wires and the manner of cutting the elongated wire-containing member may be varied to thereby adjust the resistance value of the thermistor body such that products with a series of different resistance values can be obtained.

What is claimed is:

1. A method of producing organic thermistor devices comprising the steps of:

molding an organic thermistor material by covering a plurality of electrically conductive members to thereby form a conductor-containing member, which is elongated in a longitudinal direction, has a pair of mutually oppositely facing side surfaces, having said conductive members buried parallel to one another inside said organic thermistor material, each mutually adjacent pair of said conductive members having externally exposed parts on different ones of said side surfaces;

forming a pair of electrodes elongated in said longitudinal direction on said side surfaces of said conductor-containing member; and thereafter cutting said conductor-containing member transversely to said longitudinal direction at specified positions to thereby divide into individual units;

wherein said elongated electrodes on said side surfaces of said conductor-containing member are formed by the steps of:

coating exposed surfaces of said conductor-containing member entirely with an electrically insulating material;

thereafter removing said insulating material from said side surfaces and thereby exposing edges of said conductive plates on said side surfaces; and thereafter forming said electrodes on said side surfaces.

2. The method of claim 1 wherein said conductive members are mutually parallel plates of thickness 10–200 $\mu$m.

3. The method of claim 2 wherein surface roughness of said plates is $R_a$=0.1–10.0 $\mu$m.

4. The method of claim 1 wherein said conductive members are metallic wires which extend parallel to one another.

5. The method of claim 4 wherein said metallic wires have a circular cross-sectional shape.

* * * * *